United States Patent [19]

Müeller et al.

[11] Patent Number: 4,632,706

[45] Date of Patent: Dec. 30, 1986

[54] CONTROLLED PROCESS FOR THE SURFACE TREATMENT OF METALS

[75] Inventors: Dieter J. Müeller, Marl; Hans-Juergen Busse, Schermbeck, both of Fed. Rep. of Germany

[73] Assignee: Huels Aktiengesellschaft, Marl, Fed. Rep. of Germany

[21] Appl. No.: 656,196

[22] Filed: Oct. 1, 1984

[30] Foreign Application Priority Data

Sep. 29, 1983 [DE] Fed. Rep. of Germany ..... 33335266

[51] Int. Cl.[4] ..... C23F 7/08; B05D 7/14; C23G 5/00

[52] U.S. Cl. ..... 148/6.15 R; 148/6.2; 148/6.14 R; 134/3

[58] Field of Search ..... 148/6.14 R, 6.15 R, 148/6.15 T, 62; 134/3

[56] References Cited

U.S. PATENT DOCUMENTS 3,232,594 2/1966 Ond ..... 148/6.15 R
4,070,521 1/1978 Rowe ..... 148/6.15
4,353,323 10/1982 Koblenger ..... 148/6.15

*Primary Examiner*—Sam Silverberg
*Attorney, Agent, or Firm*—Millen & White

[57] ABSTRACT

A control system for the surface treatment of metals in a bath open to the atmosphere, containing an organic solvent and reactive component, and being superimposed by a cold cushion of air forming a condensate of solvent and condensed humidity, comprising passing resultant condensate to a phase separator to separate an organic phase from an aqueous phase, said aqueous phase containing both solvent and reactive component, recycling said organic phase to the treatment tank, passing the aqueous phase from the phase separator to an overflow tank; dosing a readjustment solution to said bath to make up for losses of components therein; adjusting the components, except for water, in the readjustment solution to obtain the same proportion of the same components in the overflow tank, the water in said readjustment solution being adjusted to have a lower concentration than the water concentration in said overflow tank and a sufficiently high concentration to avoid localized concentrations of the reactive components in the bath, and withdrawing from said overflow tank sufficient aqueous phase to maintain a constant volume of liquid in the treatment tank, a pumping arrangement of mechanically coupled or synchronous pumps being used for the dosing of the readjustment solution and the withdrawal of the aqueous phase.

5 Claims, 1 Drawing Figure

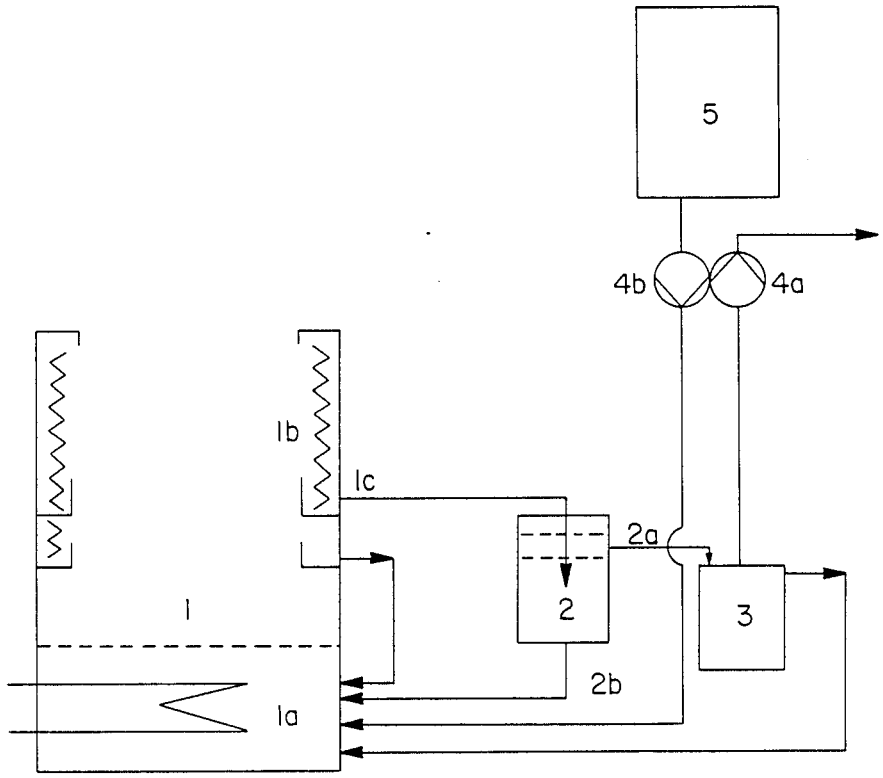
5
4b
4a
1b
1c
2a
2
3
1
2b
1a

CONTROLLED PROCESS FOR THE SURFACE TREATMENT OF METALS

BACKGROUND OF THE INVENTION

This invention relates to the surface treatment of metals, defined as degreasing, pickling, phosphatizing or lacquering, in particular to maintaining steady state conditions during such treatment, and especially wherein the surface treatment is conducted in a substantially non-aqueous liquid bath in a tank not hermetically sealed from the ambient atmosphere.

Liquid baths to which this invention is directed are described, e.g., in German patent applications Nos. P 32 09 829.4, P 33 14 974.7 and P 33 24 823.0, incorporated by reference herein, these applications corresponding to U.S. Pat. No. 4,451,301 and U.S. patent application Ser. No. 603,273 filed Apr. 24, 1984.

The liquids on a nonaqueous basis suitable for surface treatment are organic solvents which include, for example, low-boiling halogenated hydrocarbons such as dichloromethane, chloroform, trichlorofluoromethane, dichlorometahne, trichloroethylene, 1,1,1-trichloroethane, 1,1,3-trichloroethane and mixtures of these chlorinated hydrocarons.

Frequently used as solubilizers in pickling and phosphatizing baths are low-boiling alcohols such as methanol, ethanol, isopropanol, propanol, butanol, sec-butanol, tert-butanol, n-pentanol, sec-pentanol, hexanol, heptanol, octanol, 2-ethylhexanol, nonanol, decanol, undecanol, dodecanol and their mixtures.

In addition, such formulations often also contain stabilizers such as quinones, phenols, nitrophenols or nitromethane.

The following compounds are also frequently used as inhibitors: nitroureas, thioureas, methylthiourea, ethylthiourea, dimethylthiourea, diethylthiourea and alkylated thioureas.

Still further, pyridine and picric acid can optionally be used as accelerators.

The main solvent, i.e. the chlorinated hydrocarbon, in pickling and phosphatizing solutions is generally present at 60 to 85% by weight, and the aqueous phosphoric acid at 0.1 to 2% by weight, based on the total solution.

In degreasing baths, the chlorinated hydrocarbons are generally present in a concentration over 95% while in dipping lacquer baths, the solvent portion as a rule is between 30 and 70%, the remainder consisting essentially of bonding agents and pigments.

This invention relates especially to treatment tank facilities in which the baths are based on organic solvent systems containing individual reactive components and from which other components of the baths must be discharged continuously or periodically, as is the case, e.g., pickling or phosphatizing facilities on a solvent basis. For these baths, a virtually constant composition of the treatment bath should be maintained in every operating phase even though, operating continuously in a nonfixed ratio, on the one hand reactive components are consumed and on the other hand, other components are discharged.

Commercial treatment tank facilities for the surface treatment of materials and other materials are known which consist of a tank having a lower heatable zone to receive a treatment bath and an upper cooling zone to produce a cold gas cushion over the optionally boiling bath so as to mitigate solvent loss. Below the cooling zone and/or within the cooling zone there is a condensate channel or, according to a recent proposal, there are also several condensate channels in which the solvent vapors are condensed. Since the cooling zone is not heremetically sealed from the ambient atmosphere, in addition to the solvent vapors,water also condenses from the humidity in the air, so that an actual collected condensate is richer in water than a theoretical condensate corresponding to the state of equilibrium over the liquid phase. To maintain a bath condition as constant as possible, it is therefore conventional to separate the collected condensate optionally, by super cooling, into (1) a phase as predominantly aqueous as possible and (2) a predominantly organic phase. The aqueous phase contains, inter alia, 40 to 90% of water, the remainder consisting essentially of dissolved chlorinated hydrocarbons optionally with the above-mentioned solubilizers and other water-soluble or hydrophilic components from the bath. The organic phase contains 90 to 99% chlorinated hydrocarbons, the remainder consisting essentially of the above-mentioned solubilizers, optionally water and other chlorinated-hydrocarbon-philic components from the treatment bath.

Separation into two phases usually takes place in a phase separation vessel formed as a water separator. While the organic phase can be directly recycled to the bath, the aqueous phase must be discharged to eliminate the excess water. In this connection, the principal problem arises that with the aqueous phase, other components of the bath, are also discharged, such as, e.g., especially the solubilizer and chlorinated hydrocarbon dissolved by the solubilizer. As a result, undesired changes in the composition of the bath occur. If the bath contains water from the start, even more water can be undesirably discharged than is fed in by condensation, so that the bath loses water despite the fact that water is fed in from the ambient atmosphere.

A further change ion the composition of the bath results from the fact that the metal surface to be treated reacts while consuming reactive bath components. Thus, for example, phosphoric acid is consumed in the phosphatizing of metal surfaces; consequently, make-up phosphoric acid must be added to maintain a bath composition as constant as possible. In adding make-up reactive component, e.g., phosphoric acid, a disadvantage arises insofar as the reactive component, e.g., 85% phosphoric acid, cannot simply be proportionately dosed in commercial form into the treatment bath because non-uniform localized concentrations would occur in the bath which in turn would lead to trouble in the surface treatment and to unacceptable inhomogeneities in the resulting phosphate layer.

Dosing of the reactive component, e.g., phosphoric acid, into the treatment bath must therefore take place in a suitable mixture of dilution compatible with the bath. As a result, a principal problem again arises that as a result of the redosing, not only is the consumed phosphoric acid balanced, but also other components, such as, e.g., especially water and solubilizers, optionally also chlorinated hydrocarbons, depending upon choice, are fed into the above-mentioned mixture, which cause shifts in the composition of the bath.

Therefore, considering the aqueous phase, on the one hand various components in addition to water are discharged from the system, and on the other hand, aside from the reactive components, various other components are added in a mixture by dosing to replace the consumed reeactive components. The shifts of the concentration ratios in the composition of the bath connected therewith are not easy to avoid since the rate of flow of the discharged quantities of material is variable and is dependent on the heating and cooling capacity, the thermal convection in the tank, and the tank geometry. Likewise, the dosed quantities of material are variable because they have to conform with the metal surface throughput. Thus, in principle, there is no firm correlation between the resulting discharge quantity and the required dosing quantity because the former is independent of the metal surface throughput and the latter is correlated with the metal surface throughput. The problems connected with keeping the bath composition and the tank volume constant are fundamental in nature and thus far have not been solved.

SUMMARY OF THE INVENTION

An object of this invention, therefore, is to provide an improved process and associated apparatus for obtaining a substantially constant composition and volume in the treatment tank.

Upon further study of the specification and appended claims, further objects and advantages of this invention will become apparent to those skilled in the art.

To attain these objects, there is provided in a process for the surface treatment of metals in a substantially non-aqueous liquid bath in a treatment tank open to the ambient atmosphere of humidity-containing air, said treatment tank having a heatable lower zone an upper cooling zone and at least one condensate channel, said bath containing an organic solvent and reactive component, said process comprising heating the bath during the surface treatment, thereby evolving vapor from said bath, cooling said vapor to condense both resultant bath vapor and water from the humidity in the air, passing resultant condensate to a phase separator to separate an organic phase from an aqueous phase, said aqueous phase containing both solvent and reactive component, withdrawing said aqueous phase from the phase separator and recycling said organic phase to the treatment tank, and adding a readjustment solution to said bath to make up for losses of components therein, the improvement which comprises passing the aqueous phase from the phase separator to an overflow tank; adjusting the components, except for water, in the readjustment solution to obtain the same proportion of the same components in the overflow tank, the water in said readjustment solution being adjusted to have a lower concentration than the water concentration in said overflow tank and a sufficiently high concentration to avoid localized concentrations of the reactive components in the bath, and withdrawing from said overflow tank sufficient aqueous phase to maintain a constant volume of liquid in the treatment tank.

It is to be understood that the term "treatment tank open to the ambient atmosphere" signifies installations in which the solvent vapors are constantly exchanged with the ambient atmosphere. Even if the treatment tank has a cover, but an exchange between solvent vapors in the installation and the ambient atmosphere still occurs, assuming that the facility is still in operation according to specifications, the covered tank still comes under the definition of "treatment tank open to the ambient atmosphere". Also, the term "reactive component" includes any chemical, dissolved in the solvent, which has a function in the bath, but which does not necessarily react with anything. It is, however, consumed by the metal surface and is therefore a consumable component.

BRIEF DESCRIPTION OF DRAWING

The attached drawing is a schematic illustration of a preferred embodiment of the invention.

DETAILED DESCRIPTION OF DRAWING

The metal treatment plant for performing the surface treatment according to the invention comprises a treatment tank 1 which is heatable in the lower part 1*a* and which is filled with a treatment bath based on an organic solvent system, such as the one described in the German patent application No. P 32 09 829.4. The solvent vapors which, because of heating, may optionally rise to the boiling point of the system are for the most part condensed in the upper cooling zone 1*b* and the resultant condensates accumulate in the channels arranged in the cooling area. In addition, especially in the colder zones, condensed water from the ambient atmosphere also gets into the condensate. This additional water accumulates as collected condensate in the upper channel 1*c*—i.e. in general those channel nearest to the opening of the treatment tank towards the ambient atmosphere—together with the solvent vapors condensed above this upper channel. The main quantity of the vapors condense without entraining additional water from the humidity-containing ambient atmosphere in the lower channel (or channels). The collected condensates in the lower channel are directly recycled to the treatment tank (chamber 1).

The collected condensate in the usual manner is fed into a phase separator 2 dimensioned to provide a sufficient residence time for the condensate, which optionally after cooling, is split into a phase 2*a*, as predominantly aqueous as possible, and into a predominantly organic phase 2*b*. The predominantly organic phase is recycled to chamber 1. The aqueous phase according to the invention is fed into a suitably dimensioned overflow tank 3, whose overflow is also recycled to chamber 1. Moreover the overflow tank 3 possesses a discharge pipe which leads to a discharge pump 4*a*. This is either a twin-head, twin-diaphragm, twin-impeller, or twin-barrel pump having a mechanical coupling or another pump 4*b* synchronously operated in an appropriate manner. The synchronously operated pump 4*b* is a dosing pump which does a suitable readjustment solution from a storage tank 5, which contains in a specific concentration, reactive components consumed in the metal surface treatment.

The process according to the invention works in the following manner: The readjustment solution from (5), which contains the reactive component in a relatively high concentration in homogenous solution, is dosed either continuously or intermittently by means of pump 4*b* at a rate dependent on the consumption of reactive component, so that the consumption and feed of reactive component are always balanced within tolerable limits. The proportions of the other components besides the reactive components in the readjustment solution, except for the water content, largely correspond exactly to the proportions of the aqueous phase in the overflow tank. On the other hand, the water content of the readjustment solution is lower by the amount of water that is condensed from the ambient atmosphere during operation of the installation.

If, in the dosing of the reactive components to the bath, excessive readjustment solution is added, a corresponding quantity of liquid is removed by pump 4a from the overflow tank 3. Thus it is assured that the excess liquid mixture dosed by pump 4b, a mixture that serves to dilute the reactive component, is removed in equal quantity from the system, so that the treatment tank bath volume and the concentration ratios in the bath remain constant. The ratio of the pump delivery 4a/4b is constant and set by the concentration of a reactive component in the readjustment solution.

The mode of operation will be additionally explained below:

Two operating conditions are to be considered:

1. The Waiting State of the Installation

This means the condition of the installation when the latter is ready for operation, but not supplied with parts to be treated.

The bath liquid is usually already in boiling condition. The treatment chamber is sealed off against the atmosphere, for example by means of a lid or cover cap, not shown separately in the drawing. In this case, no atmospheric humidity can enter the chamber and be precipitated as additional condensate. In this condition, the pumps 4a/4b are not in operation.

2. The Operating Condition of the Installation

In this condition, workpieces are being treated in the installation. Only in this condition is the treatment chamber constantly or intermittently open with respect to the atmosphere. In this case, water can enter the chamber from the atmosphere or from the workpiece surface and can condensate additionally in the upper condensation channel 1c.

The preceding description of the process (page 6, line 31, to page 8, line 23, and page 9, line 13, to page 9A, line 27) relates to this operating condition.

It is evident that the overflow tank must be so dimensioned that with synchronous operation of pumps 4a and 4b the supply of aqueous phase in the overflow tank is just sufficient for maximum metal surface throughput.

In general, for steady state conditions the overflow tank is completely filled and the water-containing phase 2a is constantly overflowing back to the treatment-tank when the pumps 4a/4b, are not in operation.

Of course, in the case that the pumps are working for readjusting the concentration of the reactive component(s) in the treatment tank 1, the treatment tank 1 on one hand will be overfilled a short time whereas the overflow tank 3 on the other hand will be underfilled a short time. The overfilling of the treatment tank 1 fades away as the boiling liquid bath partly vaporizes. The vapors themselves are partly condensed in the upper condensate channel and pass via the separation tank 2 into the overflow tank 3 which is then filled until overflowing. The overflow tank 3 therefore has to be dimensioned so that way, that it contains at least that volume which is removed by pump 4a when pump 4b is operated simultaneously for readjusting the treatment bath. In meantime, when the pumps do not work the rate of vaporization velocity from the liquid bath and the condensing velocity in the upper channel must be high enough to fill the overflow tank 3 completely before starting of the pumps anew.

The accumulation of condensed humidity is ensured by a correspondingly designed heating capacity and construction of the cooling zone.

If less readjustment solution must be dosed in on account of reduced metal surface throughput, correspondingly more aqueous phase is merely recycled by the overflow in to chamber 1. The is applies essentially to downtime and rest periods in which the bath is kept operational without surface treatment in a sealed condition.

By sealed condition is meant a bath which is closed to the ambient atmosphere when no workpiece surfaces are treated.

The device according to the invention and the process according to the invention together offer the advantage already mentioned that the contents of the bath can be kept constant in a simple manner both with respect to concentration ratios and volume at every operational state with variable metal surface throughput, including downtimes. The concentration of reactive component in the readjustment solution can be set in a suitable manner. Then the constant ratio of delivery of pumps 4a and 4b is also determined by it.

The measures according to the invention are suitable especially for fully automatic redosing since a synchronous approach to a combined dosing arrangement is possible by determining the quantity of reaction component in the treatment bath.

The example below describes the process by citing two cases of phosphatizing. This mode of operation can likewise be employed analogously in connection with degreasing, pickling, and lacquering.

EXAMPLES

A phosphatizing chamber 1 according to FIG. 1 with a 1-ton charge of a phosphatizing bath consisting of 74% $CH_2Cl_2$, 21% $CH_3OH$, 5% $H_2O$, and 1% $H_3PO_4$ is heated in such a way that the phosphatizing bath boils at 37°-38° C. and so that about 101 kg/h of the bath is vaporized. Of this amount, the main quantity of about 100 kg/h is condensed in the lower condensation channel and is directly recycled into chamber 1.

During this step, about 1 kg/h of condensate from 1c is obtained in the upper condensation channel 1c; in the operating condition of the installation, this condensate also contains the water condensed from the surrounding atmosphere, amounting to about 5 g/h. This condensate passes into the water separator 2 with a filling volume of about 5 l, forming, by cooling to 30° C., an upper aqueous phase 2a of about 0.1 kg/h having a composition of about 45% by weight $H_2O$, 52% by weight $CH_3OH$, 3% by weight $CH_2Cl_2$. This aqueous phase flows off into the overflow tank 3 with a filling volume of 0.2 l. The lower organic phase 2b passes directly back into the phosphatizing chamber.

Case 1

Approximately 15 g/h of $H_3PO_4$ is consumed in the phosphatizing of a workpiece surface of about 10 $m^2/h$, so that, each hour, approximately 30 g of a replenishing solution containing about 50% by weight $H_3PO_4$, 22.5% $H_2O$, 26% $CH_3OH$, and 1.5% $CH_2Cl_2$ must be added from tank 5 in metered amounts via pump 4b. During this step, approximately 15 g of aqueous phase is withdrawn from the overflow tank per hour by way of pump 4a. The pump efficiency ratio 4a/4b is consequently about 0.5.

Case 2

Approximately 75 g/h of $H_3PO_4$ is consumed in the phosphatizing of a workpiece surface of about 50 $m^2/h$, so that, each hour, approximately 150 g of replenishing solution is added by dosing, and 75 g of aqueous phase is withdrawn from the overflow tank. The pump efficiency ratio 4a/4b is about 0.5, as in case 1.

The overflow tank is thus adequately dimensioned, with a filling volume of 0.2 l, and with an accumulation of 100 g/h of aqueous phase (*2a*) will again be refilled to overflowing within respectively 45 minutes. In this way, the tank is always filled with an hourly pump startup.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the surface treatment of metals in a substantially non-aqueous liquid bath in a treatment tank open to the ambient atmosphere of humidity-containing air, said treatment tank having a heatable lower zone, an upper cooling zone and at least one condensate channel, said bath containing an organic solvent and chemically reactive component, said process comprising heating the bath during the surface treatment, thereby evolving vapor from said bath, cooling said vapor to condense both resultant bath vapor and water from the humidity in the air, passing resultant condensate to a phase separator to separate an organic phase from an aqueous phase, said aqueous phase containing both solvent and the chemically reactive component, withdrawing said aqueous phase from the phase separator and recycling said organic phase to the treatment tank, and adding a readjustment solution to said bath to make up for losses of components therein, the improvement which comprises passing the aqueous phase from the phase separator to an overflow tank; adjusting the components, except for water, in the readjustment solution to obtain the same proportion of the same components in the overflow tank, the water in said readjustment solution being adjusted to have a lower concentration than the water concentration in said overflow tank and a sufficiently high concentration to avoid localized concentrations of the chemically reactive component in the bath, withdrawing from said overflow tank sufficient aqueous phase to maintain a constant volume of liquid in the treatment tank, and also recycling overflow aqueous phase from the overflow tank to the treatment tank.

2. A process according to claim 1, wherein the condensate is removed from the treatment tank at the surface thereof.

3. A process according to claim 1, wherein the withdrawal of the aqueous phase from the overflow tank and the dosing of the readjustment solution are conducted by a twin-head, a twin-diaphragm, a twin-impeller, or a twin-barrel pump or by individual pumps coupled to be synchronously operated wherein the ratio of the pump deliveries is dependent on the concentration of the chemically reactive component in the readjustment solution.

4. A process according to claim 1, wherein the surface treatment is phosphatizing.

5. A process according to claim 4, wherein the withdrawal of the aqueous phase from the overflow tank and the dosing of the readjustment solution are conducted by a twin-head, a twin-diaphragm, a twin-impeller, or a twin-barrel pump or by individual pumps coupled to be synchronously operated wherein the ratio of the pump deliveries is dependent on the concentration of the chemically reactive component in the readjustment solution.

* * * * *